US007992285B2

(12) United States Patent
Deng et al.

(10) Patent No.: US 7,992,285 B2
(45) Date of Patent: Aug. 9, 2011

(54) METHOD FOR FABRICATING NEGATIVE TEMPERATURE COEFFICIENT THERMISTOR

(75) Inventors: Wen-How Deng, Hsinchu (TW); Tsung-Wen Chen, Hsinchu (TW); Shin-Shing Lo, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 559 days.

(21) Appl. No.: 12/201,899

(22) Filed: Aug. 29, 2008

(65) Prior Publication Data

US 2009/0165289 A1 Jul. 2, 2009

(30) Foreign Application Priority Data

Dec. 26, 2007 (TW) ..... 96150198 A

(51) Int. Cl.
*H01C 7/02* (2006.01)
*H01C 7/04* (2006.01)

(52) U.S. Cl. ..... 29/612; 29/619; 29/621

(58) Field of Classification Search ..... 29/612, 29/610.1, 611, 619–621; 241/1, 23; 338/22 R, 338/25, 195; 524/431, 495
See application file for complete search history.

(56) References Cited

U.S. PATENT DOCUMENTS 7,007,872 B2 * 3/2006 Yadav et al. ..... 241/1
2008/0009578 A1 * 1/2008 Khatua et al. ..... 524/431

* cited by examiner

*Primary Examiner* — Thiem Phan
(74) *Attorney, Agent, or Firm* — Muncy, Geissler, Olds & Lowe, PLLC

(57) ABSTRACT

A method for fabricating a negative temperature coefficient thermistor is provided, including the steps of: (A) combining ceramic powders having a negative temperature coefficient of resistance, a polymer binder and a solvent to form a mixture; (B) removing the solvent and granulating the mixture to form granulous powders; (C) compressing the granulous powders to obtain a thermistor material with a specific shape; (D) curing the thermistor material at 80° C. to 350° C.; and (E) mounting an electrode to the thermistor material to form the negative temperature coefficient thermistor. The method can be performed in a low temperature without the problem of interface diffusion. Further, the desired resistance value and thermistor constant (B) can be easily adjusted and obtained by mixing ceramic powders with different characteristics of temperature coefficient of resistance and/or the addition of conductive metal powder.

21 Claims, No Drawings

METHOD FOR FABRICATING NEGATIVE TEMPERATURE COEFFICIENT THERMISTOR

CROSS-REFERENCE TO RELATED APPLICATION

This application claims priority of Application No. 096150198 filed in Taiwan, R.O.C. on Dec. 26, 2007 under 35 U.S.C. §119, the entire contents of which are hereby incorporated by reference.

FIELD OF THE INVENTION

The present invention relates to methods for fabricating negative temperature coefficient thermistors, and more particularly, to a method for fabricating a negative temperature coefficient thermistor in a low temperature.

BACKGROUND OF THE INVENTION

Owing to the blooming development of various portable electronic products, the development of fabrication of elements focuses on microminiaturization and the flexibility of substrates. In view of the advantages of low cost and high flexibility, of low-temperature processes, in fabricating embedded elements or monolithic elements, processes for fabricating elements applied in flexible substrates are intended to focus on processes practicable in low temperature and printable processes.

The resistance of a negative temperature coefficient (NTC) thermistor decreases as a temperature increases. Since the temperature coefficient of resistance of the NTC thermistor is high and is stable in a wide range of temperatures, the NTC thermistor can be applied to temperature compensation, temperature measurement, liquid level sensing and current limit, and so on. For forming a spinel phase having semiconductor characteristics, the ceramic sintering temperature of sintered bodies is usually over 1200° C. On the other hand, thick film NTC thermistor ink is prepared by mixing ceramic powders having a negative temperature coefficient of resistance, a glass binder, and a polymer carrier. The thermistor is obtained by screen-printing the thermistor ink on insulating substrates and then performing sintering at a temperature above 700° C. However, the high fabrication temperature (above 700° C.) limits the application of such thick film NTC thermistor to ceramic substrates.

Moreover, WO9918581 and U.S. Pat. No. 5,980,785 are related to decreasing fabrication temperatures, wherein after low melting-point metals, such as Bi, Sn, Pb, In and Se, are mixed with high melting-point metals, the mixture is subjected to a thermal treatment by heating below 300° C. to form intermetallics showing the characteristics of a resistance or a NTC thermistor. Most of the low melting-point metals applied in the above method belong to the elements harmful to the environment, such as Pb, In and Sn. Furthermore, it is difficult to control the characteristics of the intermetallics, since the forming of the intermetallics is more temperature-sensitive. Besides, the B values of the intermetallics are usually below 2000. As compared with the high B values (e.g. 3000 to 4500) for the generally used NTC thermistor products, the intermetallics having lower B values cannot meet the criterion of being used in NTC thermistor.

To increase the efficiency of modulating the characteristics of elements, U.S. Pat. No. 7,135,955 discloses a method for fabricating a NTC thermistor by multi-layer ceramics processes. Two or more materials having different negative temperature coefficients are stacked on different layers. The purpose of controlling the eventual NTC thermistor characteristics is achieved by the arrangement of stacking different materials. There is no need to modulate the constitution and the amount ratio of the materials in response to different characteristics of elements. However, the element disclosed in this prior art still belongs to a ceramic element sintered at a high temperature. It tends to encounter diffusion and homogenization at interfaces between the stacked materials with different characteristics during high temperature co-firing, and even have reactions therewith taking place. Therefore, it is difficult to control the final characteristics of the fabricated element. Moreover, co-construction of different materials cannot surely satisfy the criteria of products both in B value and room temperature resistance value.

Accordingly, the problem to be solved here is to develop a method for fabricating a negative temperature coefficient thermistor in a low temperature, and the negative temperature coefficient thermistor can meet the demands for modulating both the B value and the room temperature resistance value.

SUMMARY OF THE INVENTION

In view of the foregoing drawbacks of the prior art, a primary objective of the present invention is to provide a method for fabricating a negative temperature coefficient thermistor in a low temperature.

Another objective of the present invention is to provide a method for fabricating a negative temperature coefficient thermistor, wherein a resistance value of the thermistor can be adjusted.

A further objective of the present invention is to provide a method for fabricating a negative temperature coefficient thermistor, wherein a thermistor constant can be adjusted.

In order to attain the above and other objectives, the present invention provides a method for fabricating a negative temperature coefficient thermistor, comprising the steps of: (A) combining powders having a negative temperature coefficient of resistance, a polymer binder and a solvent to form a mixture, wherein an amount of the polymer binder is 1 to 25 wt % based on a total weight of the mixture, and a weight ratio of the solvent to the powders is in a range of 1:1 to 5:1; (B) removing the solvent and granulating the mixture to form granulous powders; (C) compressing the granulous powders to obtain a thermistor material with a specific shape; (D) curing the thermistor material at a temperature of 80° C. to 350° C.; and (E) mounting an electrode to the thermistor material to form the negative temperature coefficient thermistor. The method of the present invention can be carried out in a low temperature without the problem of interface diffusion in the prior art. Further, the desired resistance value and thermistor constant (B value) can be easily adjusted and obtained by mixing ceramic powders with different characteristics of negative temperature coefficient and/or the addition of conductive metal powders according to the method of the present invention. The amount of the conductive metal powders is no more than 35 wt % based on the total weight of the mixture.

DETAILED DESCRIPTION OF THE PREFERRED EMBODIMENTS

The following specific embodiments are provided to illustrate a method for fabricating a negative temperature coefficient thermistor as proposed by the present invention. Persons skilled in the art can readily gain an insight into other advantages and features of the present invention based on the disclosure in this specification.

The method for fabricating a negative temperature coefficient thermistor, of the present invention, uses a mixture comprising ceramic powders having a negative temperature coefficient of resistance, a polymer binder, a solvent, and optionally, conductive metal powders, wherein the ceramic powders having a negative temperature coefficient of resistance can be obtained by sintering raw material powders. Firstly, one or more metal oxides, such as oxides of Mn, Co, Ni, Cu, and/or Fe, are ground by a ball milling process using a grinding medium such as zirconia balls. Preferably, two or more metal oxides are ground to obtain a mixture. Next, calcination is performed, for example, at 1050° C. to obtain calcined powders. A polymer binder is added to the resultant calcined powders. By ball milling and spray drying, ball-type granulous powders are formed with a grain size of 50 to 120 μm. Then, the ball-type granulous powders are degreased at 300° C. to 600° C. in a crucible, and followed by sintering at 1250° C. to 1400° C., so as to obtain ceramic powders. Optionally, the ceramic powders may be further subjected to the ball milling process to form powders with a grain size of about 0.1 to 30 μm and having a negative temperature coefficient of resistance. The method of the present invention can use a mixture of powders having different characteristics of negative temperature coefficient of resistance. In one embodiment, the grain size of the ceramic powders is in a range of 0.1 to 120 μm, and preferably, in a range of 0.1 to 30 μm.

The mixture used in the method of the present invention comprises a polymer binder, and optionally, conductive metal powders, in addition to the ceramic powders having a negative temperature coefficient of resistance. The polymer binder is primarily used for binding the powders. Preferably, a thermosetting polymer with a high binding strength of molecules and excellent thermostability is used. Examples of the polymer binder include, but not limited to, epoxy resin, polyimide, phenolic resin, polyurethane, melamine, polytetrafluoroethylene, and/or silicone resin, wherein epoxy resin or polyimide is preferred. Poor adhesion can result from an insufficient amount of the polymer binder. On the other hand, an excessive amount of the polymer binder can result in insufficiency of the ceramic powders having a negative temperature coefficient of resistance in the mixture. In one embodiment, the mixture used in the method of the present invention comprises 1 to 25 wt % of the polymer binder based on the total weight of the mixture, and preferably, 3 to 15 wt %.

In the method of the present invention, the polymer binder is used to aid in formation of a thermistor with a higher resistance value, and the conductive metal powders optionally added are used for adjusting the resistance value of the thermistor. Usually, based on the total weight of the mixture, the mixture used in the present invention comprises 0 to 35 wt % of the conductive metal powders, and preferably, 5 to 25 wt %. Examples of the conductive metal powders include, but not limited to, powders of Ag, Au, Pd, Pt, Ru, Cu, Ni, Fe, Zn, Sn, Mo, Ti, Cr, Al, and/or Pb. In one embodiment, the mean grain size of the conductive metal powders is in a range of 0.1 to 10 μm, and preferably, in a range of 0.5 to 5 μm.

Generally, in the mixture used in the method of the present invention, the weight ratio of the solvent to the ceramic powders is in a range of 1:1 to 5:1, and preferably, in a range of 2:1 to 4:1. The solvent used in the method of the present invention is not particularly limited. A solvent dissolvable in the polymer binder and capable of being readily removed sequentially is suitably used in the present invention. After removing the solvent by heating and granulating the mixture to form granulous powders, the granulous powders are compressed at 1500 to 2000 Kg/cm$^2$ to obtain a thermistor material with a specific shape, such as a tablet. The thermistor material is cured in a low temperature, for example, at 80° C. to 350° C., and preferably, at 80° C. to 300° C., and more preferably at 180° C. to 230° C., in accordance with the polymer binder used. Finally, an electrode is mounted to the thermistor material to form the negative temperature coefficient thermistor.

The method of the present invention is practicable in a low temperature without the problem of interface diffusion in the prior art. Further, the desired resistance value and thermistor constant (B value) can be easily adjusted and obtained by mixing powders with different characteristics of negative temperature coefficient of resistance and/or the addition of conductive metal powders. The negative temperature coefficient thermistor, with the room temperature resistance value being in a range of 10 kΩ·cm to 20 MΩ·cm and the thermistor constant (B value) being in a range of 3500 to 4500, may be formed.

EXAMPLES

The Components Used in the Examples are Described as Follows

Epoxy Resin 1: EVERWIDE JB 306
Epoxy Resin 2: EVERWIDE JB 273

The Components Used in the Examples are Described as Follows

The zero power resistance of an element is measured, and the B value of the element is obtained from the following formula, $$B = \frac{\mathrm{Ln}\frac{R_1}{R_2}}{\frac{1}{T_1} - \frac{1}{T_2}}$$

wherein $R_1$ and $R_2$ are the resistance values at absolute temperature $T_1$ (K) and at absolute temperature $T_2$ (K), respectively.

Preparation Example

A material formulation composition is selected, and the material formulation has a B value of about 4050 and a room temperature resistance value of 7550 Ω·cm when synthesized into an NTC element by a conventional ceramic process. In this Preparation Example, two or more metal oxides are ground to obtain a mixture. Next, calcination is carried out, for example, at 1050° C. to obtain calcined powders. A polymer binder is added to the resultant calcined powders. By ball milling and spray drying, ball-type granulous powders are formed and have a negative temperature coefficient of resistance.

Example 1

To the ball-type ceramic powders formed in the preparation example, an amount that is 2 to 4 times the weight of the powder, of an acetone solvent, and 3 wt % of an epoxy resin 1, are added. After thorough mixing, the solvent is removed by heating, and granulous powders are formed by granulation. After a tablet is formed from the granulous powders by compression and has a diameter of 12 mm and a thickness of 1 mm, it is cured at 230° C. Finally, low temperature electrodes are mounted to two surfaces of the tablet to form Sample 1 of the negative temperature coefficient thermistor. The measured room temperature resistance value (a resistance value measured at 25° C.) is about 11.6 to 16.7 MΩ·cm, and the measured B value is about 3843 to 4030. The results are recorded in Table 1.

Examples 2 to 5

The steps in Example 1 are repeated. As described in Table 1, an amount of the polymer binder added is adjusted, and various kinds of polymer binders are used to form samples of the negative temperature coefficient thermistors. The room temperature resistance value and the B value are both measured and recorded in Table 1.

TABLE 1

| Example | Polymer Binder | Amount Added (wt %) | Curing Temperature (° C.) | Resistance Value at Room Tem. (MΩ · cm) | B Value |
|---|---|---|---|---|---|
| 1 | Epoxy Resin 1 | 3 | 230 | 11.6 | 4013 |
| 2 | Epoxy Resin 1 | 5 | 200 | 12 | 4030 |
| 3 | Epoxy Resin 1 | 15 | 180 | 16.7 | 3843 |
| 4 | Epoxy Resin 2 | 8 | 80 | 12.6 | 3918 |
| 5 | Polyimide | 3 | 300 | 13.1 | 3947 |

Example 6

The ball-type ceramic powders formed in the Preparation Example are subjected to a ball milling process for 40 hours in alcohol by zirconia balls with a diameter of 10 mm, followed by baking and grinding. An amount that is 2 to 4 times the weight of the powders, of an anceton solvent and 3 wt % of epoxy resin 1, are added. After thorough mixing, the solvent is removed by heating, and granulous powders are formed by granulation. After a tablet is formed from the granulous powders by compression and has a diameter of 12 mm and a thickness of 1 mm, it is cured at 230° C. Finally, low temperature electrodes are mounted to two surfaces of the tablet to form Sample 6 of the negative temperature coefficient thermistor. The measured room temperature resistance value is about 750 MΩ·cm, and the measured B value is about 4160. The results are recorded in Table 2.

Examples 7 to 11

The steps in Example 6 are repeated. As described in Table 2, an amount of the conductive metal powders added is adjusted, to form samples of the negative temperature coefficient thermistors. The room temperature resistance value and the B value are both measured and recorded in Table 2.

TABLE 2

| Example | Metal Powders | Mean Grain Size (μm) | Amount (wt %) | Resistance Value at Room Tem. | B Value |
|---|---|---|---|---|---|
| 6 | — | — | 0 | 750 kΩ · cm | 4160 |
| 7 | Ag powders | 0.5 | 5 | 356 kΩ · cm | 4030 |
| 8 | Ag powders | 0.5 | 10 | 135 kΩ · cm | 4085 |

TABLE 2-continued

| Example | Metal Powders | Mean Grain Size (μm) | Amount (wt %) | Resistance Value at Room Tem. | B Value |
|---|---|---|---|---|---|
| 9 | Ag powders | 0.5 | 15 | 55 kΩ · cm | 4065 |
| 10 | Ag powders | 0.5 | 25 | 16 kΩ · cm | 4050 |
| 11 | Pd powders | 0.65 | 15 | 88 kΩ · cm | 4060 |

According to the results, the method of the present invention is practicable in a low temperature, and the desired resistance value and thermistor constant (B value) can be easily adjusted and obtained by mixing powders with different characteristics of negative temperature coefficients of resistance and/or the addition of conductive metal powders. The fabricating method of the present invention is extremely flexible, and can satisfy the demand of commercially availability.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A method of fabricating a negative temperature coefficient thermistor, comprising the steps of:

(A) combining powders having a negative temperature coefficient of resistance, a polymer binder and a solvent to form a mixture, wherein an amount of the polymer binder is 1 to 25 wt % based on a total weight of the mixture, and a weight ratio of the solvent to the powders is in a range of 1:1 to 5:1;

(B) removing the solvent and granulating the mixture to form granulous powders;

(C) compressing the granulous powders to obtain a thermistor material with a specific shape;

(D) curing the thermistor material at a temperature of 80° C. to 350° C.; and (E) mounting an electrode to the thermistor material to form the negative temperature coefficient thermistor.

2. The method of claim 1, wherein the powders used in the step (A) are oxide powders selected from the group consisting of manganese oxide, cobalt oxide, nickel oxide, copper oxide, and iron oxide.

3. The method of claim 1, wherein the powders used in the step (A) comprise a mixture of powders with different characteristics of negative temperature coefficient of resistance.

4. The method of claim 1, wherein a grain size of the powders used in the step (A) is in a range of 0.1 to 120 μm.

5. The method of claim 1, wherein the mixture in the step (A) further comprises conductive metal powders in an amount of up to 35 wt % based on the total weight of the mixture.

6. The method of claim 5, wherein the amount of the conductive metal powders used in the step (A) is 5 to 25 wt % based on the total weight of the mixture.

7. The method of claim 5, wherein the conductive metal powders used in the step (A) are selected from the group consisting of powders of Ag, Au, Pd, Pt, Ru, Cu, Ni, Fe, Zn, Sn, Mo, Ti, Cr, Al, and Pb.

8. The method of claim 5, wherein the conductive metal powders used in the step (A) are powders of Ag.

9. The method of claim 5, wherein the conductive metal powders used in the step (A) are powders of Pd.

10. The method of claim 5, wherein a mean grain size of the conductive metal powders used in the step (A) is in a range of 0.1 to 10 μm.

11. The method of claim 1, wherein the amount of the polymer binder used in the step (A) is 3 to 15 wt % based on the total weight of the mixture.

12. The method of claim 1, wherein the polymer binder used in the step (A) is a thermosetting polymer.

13. The method of claim 1, wherein the polymer binder used in the step (A) is one selected from the group consisting of epoxy resin, polyimide, phenolic resin, polyurethane, melamine, polytetrafluoroethylene, and silicone resin.

14. The method of claim 1, wherein the polymer binder used in the step (A) is an epoxy resin.

15. The method of claim 1, wherein the polymer binder used in the step (A) is polyimide.

16. The method of claim 1, wherein the weight ratio of the solvent to the powders used in the step (A) is in a range of 2:1 to 4:1.

17. The method of claim 1, wherein the solvent used in the step (A) is acetone.

18. The method of claim 1, wherein the step (C) is carried out at 1500 to 2000 $Kg/cm^2$.

19. The method of claim 1, wherein the thermistor material in the step (D) is cured at a temperature of 80° C. to 300° C.

20. The method of claim 1, wherein a room temperature resistance value of the negative temperature coefficient thermistor formed in the step (E) is in a range of 10 kΩ·cm to 20 MΩ·cm.

21. The method of claim 1, wherein a thermistor constant of the negative temperature coefficient thermistor formed in the step (E) is in a range of 3500 to 4500.

* * * * *